US010689592B2

(12) United States Patent
Doyen

(10) Patent No.: US 10,689,592 B2
(45) **Date of Patent: *Jun. 23, 2020**

(54) LUBRICANT FOR A TWO-STROKE MARINE ENGINE

(71) Applicant: TOTAL MARKETING SERVICES, Puteaux (FR)

(72) Inventor: Valérie Doyen, Four (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

This patent is subject to a terminal disclaimer.

(21) Appl. No.: 16/073,838

(22) PCT Filed: Feb. 24, 2017

(86) PCT No.: PCT/EP2017/054328

§ 371 (c)(1),
(2) Date: Jul. 30, 2018

(87) PCT Pub. No.: WO2017/148816

PCT Pub. Date: Sep. 8, 2017

(65) Prior Publication Data

US 2019/0040333 A1 Feb. 7, 2019

(30) Foreign Application Priority Data

Feb. 29, 2016 (EP) ..... 16305228

(51) Int. Cl.
*C10M 149/22* (2006.01)
*C10M 133/06* (2006.01)
*C10M 169/04* (2006.01)

(52) U.S. Cl.
CPC ..... *C10M 149/22* (2013.01); *C10M 133/06* (2013.01); *C10M 169/041* (2013.01); *C10M 2203/003* (2013.01); *C10M 2203/1006* (2013.01); *C10M 2203/1025* (2013.01); *C10M 2203/1085* (2013.01); *C10M 2215/04* (2013.01); *C10M 2217/046* (2013.01); *C10N 2220/028* (2013.01); *C10N 2220/029* (2013.01); *C10N 2220/03* (2013.01); *C10N 2230/04* (2013.01); *C10N 2230/08* (2013.01); *C10N 2230/52* (2013.01); *C10N 2240/10* (2013.01); *C10N 2240/102* (2013.01); *C10N 2240/105* (2013.01)

(58) Field of Classification Search
CPC ..... C10M 149/22; C10M 169/041; C10M 2203/003; C10M 2217/046; C10N 2220/028; C10N 2230/00; C10N 2230/52; C10N 2240/105
See application file for complete search history.

(56) References Cited

U.S. PATENT DOCUMENTS

| | | | |
|---|---|---|---|
| 4,250,045 | A | 2/1981 | Coupland et al. |
| 9,896,639 | B2 | 2/2018 | Lancon et al. |
| 2011/0092403 | A1 | 4/2011 | Lancon et al. |
| 2018/0223218 | A1 | 8/2018 | Doyen et al. |

FOREIGN PATENT DOCUMENTS

| | | | |
|---|---|---|---|
| WO | 96/12755 | A1 | 5/1996 |
| WO | 2009/153453 | A2 | 12/2009 |
| WO | 2014/180843 | A1 | 11/2014 |
| WO | 2017/021426 | A1 | 2/2017 |

OTHER PUBLICATIONS

May 17, 2017 International Search Report issued in International Patent Application No. PCT/EP2017/054328.
Sep. 4, 2018 International Preliminary Report on Patentability issued in International Patent Application No. PCT/EP2017/054328.

*Primary Examiner* — Taiwo Oladapo
(74) *Attorney, Agent, or Firm* — Oliff PLC

(57) ABSTRACT

Relating to the field of lubricant, more particularly relates to lubricant for marine engine, notably for a two-stroke marine engine. More particularly, relates to a lubricant for a marine engine including at least one lubricant base oil and at least one fatty amine.

19 Claims, No Drawings

LUBRICANT FOR A TWO-STROKE MARINE ENGINE

RELATED APPLICATION

This application is a national stage entry of PCT/EP2017/054328, filed Feb. 24, 2017 which claims priority from continuation of European Patent Application No. 16305228.5, filed Feb. 29, 2016, which are incorporated by reference in their entirety.

The present invention relates to the field of lubricants, more particularly relates to lubricants for marine engines, notably for a two-stroke marine engine. More particularly, the present invention relates to a lubricant for a marine engine comprising at least one lubricant base oil and at least one fatty amine.

The lubricant according to the invention has an important neutralization capacity characterized by a high BN or Base Number and can be used both with high-sulphur fuel oils and low-sulphur fuel oils.

The lubricant according to the invention has an efficient neutralization capacity towards sulfuric acid formed during the combustion of high-sulphur fuel oils and has a limited or non-existent risk of viscosity increase, whilst limiting the formation of deposits generated at high temperature.

The lubricant according to the invention has an efficient neutralization capacity towards sulfuric acid formed during the combustion of low-sulphur fuel oils characterized by a low BN and has a limited or non-existent risk of viscosity increase, whilst limiting the formation of deposits generated at high temperature.

The present invention also concerns a method for lubricating a marine engine, and more particularly a two-stroke marine engine, comprising operating the engine with a lubricant according to the invention.

The present invention also concerns a method for reducing the formation of deposits in the hot section of a marine engine, notably of a two-stroke marine engine, comprising contacting said hot section of the engine with a lubricant according to the invention.

The marine oils used in low-speed two-stroke crosshead engines are of two types. On the one hand, cylinder oils ensuring the lubrication of the cylinder-piston assembly and, on the other hand, system oils ensuring the lubrication of all the moving parts apart from the cylinder-piston assembly. Within the cylinder-piston assembly, the combustion residues containing acid gases are in contact with the lubricating oil.

The acid gases are formed from the combustion of the fuel oils; these are in particular sulphur oxides (SO2, SO3), which are then hydrolyzed on contact with the moisture present in the combustion gases and/or in the oil. This hydrolysis generates sulphurous ($HSO_3$) or sulphuric ($H_2SO_4$) acid.

To protect the surface of piston liners and avoid excessive corrosive wear, these acids must be neutralized, which is generally done by reaction with the basic sites included in the lubricant.

An oil's neutralization capacity is measured by its BN or Base Number, characterized by its basicity. It is measured according to standard ASTM D-2896 and is expressed as an equivalent in milligrams of potash per gram of oil (also called "mg of KOH/g" or "BN point"). The BN is a standard criterion making it possible to adjust the basicity of the cylinder oils to the sulphur content of the fuel oil used, in order to be able to neutralize all of the sulphur contained in the fuel, and capable of being converted to sulphuric acid by combustion and hydrolysis.

Thus, the higher the sulphur content of a fuel oil, the higher the BN of a marine oil needs to be. This is why marine oils with a BN varying from 5 to 100 mg KOH/g are found on the market. This basicity is provided by detergents that are overbased by insoluble metallic salts, in particular metallic carbonates. The detergents, mainly of anionic type, are for example metallic soaps of salicylate, phenate, sulphonate, carboxylate type etc. which form micelles where the particles of insoluble metallic salts are maintained in suspension. The usual overbased detergents intrinsically have a BN in a standard fashion comprised between 150 and 700 mg KOH per gram of detergent. Their percentage by mass in the lubricant is fixed as a function of the desired BN level.

Part of the BN can also be provided by non-overbased or "neutral" detergents with a BN typically less than 150. However, the production of marine engine cylinder lubricant formulas where the entire BN is provided by "neutral" detergents cannot be envisaged: it would in fact be necessary to incorporate them in excessive quantities, which could be detrimental to other properties of the lubricant and would not be realistic from an economic point of view.

The insoluble metallic salts of the overbased detergents, for example calcium carbonate, therefore contribute significantly to the BN of the usual lubricants. It can be considered that approximately at least 50%, typically 75%, of the BN of the cylinder lubricants is thus provided by these insoluble salts. The actual detergent part, or metallic soaps, found in both the neutral and overbased detergents, typically provides most of the remainder of the BN.

Environmental concerns have led, in certain areas and in particular coastal areas, to requirements relating to the limitation of the level of sulphur in the fuel oils used on ships. Thus, the regulation MARPOL Annex 6 (Regulations for the Prevention of Air Pollution from Ships) issued by the IMO (International Maritime Organization) entered into force in May 2005. It sets a global cap of 4.5% m/m on the sulphur content of heavy fuel oils as well as creating sulphur oxide emission control areas, called SECAs (Sulphur Emission Control Areas). Ships entering these areas must use fuel oils with a maximum sulphur content of 1.5% m/m or any other alternative treatment intended to limit the SOx emissions in order to comply with the specified values. The notation m/m denotes the percentage by mass of a compound relative to the total weight of fuel oil or lubricating composition in which it is included.

More recently the MEPC (Marine Environment Protection Committee) met in April 2008 and approved proposed amendments to the regulation MARPOL Annex 6. These proposals are summarized in the table below. They present a scenario in which the restrictions on the maximum sulphur content become more severe with a worldwide maximum content reduced from 4.5% m/m to 3.5% m/m as from 2012. The SECAs (Sulphur Emission Control Areas) will become ECAs (Emission Control Areas) with an additional reduction in the maximum permissible sulphur content from 1.5% m/m to 1.0% m/m as from 2010 and the addition of new limits relating to contents of NOx and particles.

| | Amendments to MARPOL Annex 6 (MEPC Meeting No. 57 - April 2008) | |
|---|---|---|
| | General limit | Limit for the ECAs |
| Maximum sulphur | 3.5% m/m on fuel content Jan. 1, 2012<br>0.5% m/m on fuel content Jan. 1, 2020 | 1% m/m on fuel content Jul. 1, 2010<br>0.1% m/m on fuel content Jan. 1, 2015 |

Ships sailing trans-continental routes already use several types of heavy fuel oil depending on local environmental constraints, allowing them to optimize their operating costs. This situation will continue irrespective of the final level of the maximum permissible sulphur content of fuel oils. Thus the majority of container ships currently under construction provide for the utilization of several bunker tanks, for a "high sea" fuel oil with a high sulphur content on the one hand and for a 'SECA' fuel oil with a sulphur content less than or equal to 1.5% m/m on the other hand. Switching between these two categories of fuel oil can require adaptation of the engine's operating conditions, in particular the utilization of appropriate cylinder lubricants.

Currently, in the presence of fuel oil with a high sulphur content (3.5% m/m and more), marine lubricants having a BN of the order of 70 are used. In the presence of a fuel oil with a low sulphur content (1.5% m/m and less), marine lubricants having a BN of the order of 40 are used (in the future this value will be reduced). In these two cases, a sufficient neutralizing capacity is achieved as the necessary concentration in basic sites provided by the overbased detergents of the marine lubricant is reached, but it is necessary to change lubricant at each change of type of fuel oil.

Moreover, each of these lubricants has limits of use resulting from the following observations: the use of a cylinder lubricant of BN 70 in the presence of a fuel oil with a low sulphur content (1.5% m/m and less) and at a fixed lubrication level, creates a significant excess of basic sites (high BN) and a risk of destabilization of the micelles of unused overbased detergent, which contain insoluble metallic salts. This destabilization results in the formation of deposits of insoluble metallic salts (for example calcium carbonate), mainly on the piston crown, and can eventually lead to a risk of excessive wear of the liner-polishing type. Further, the use of a cylinder lubricant of BN 40 does not allow an efficient neutralization capacity in the presence of a fuel oil with a high sulphur content and thus can cause an important risk of corrosion.

Therefore, the optimization of the cylinder lubrication of a low-speed two-stroke engine then requires the selection of the lubricant with the BN adapted to the fuel oil and to the operating conditions of the engine. This optimization reduces the flexibility of operation of the engine and requires a significant degree of technical expertise on the part of the crew in defining the conditions under which the switching from one type of lubricant to the other must be carried out.

The application WO 2009/153453 discloses cylinder lubricants for two-stroke marine engines which can be used with both high-sulphur fuel oils and low-sulphur fuel oils. However, the cylinder lubricant disclosed in said application is limited and does not exceed BN 72. Further, with respect to the nature of the amine, a risk of the formation of deposits at high temperature could appear and thus alter the efficiency of the lubricant and the engine cleanliness.

Document U.S. Pat. No. 4,205,045 discloses a composition having a major portion of a lubricating oil and at least an amine or amine derivative of a hydrocarbon-soluble polymerized fatty acid, like for example a dimeramine derived from a dicarboxylic acid containing at least 12 carbon atoms. Such a composition has improved antifriction and fuel economy properties.

Document WO96/12755 discloses a dendrimer based cold flow improver comprising a central core linked through a plurality of polar groups to a dendritic body which is linked through a plurality of polar groups to a hydrocarbyl periphery, the periphery consisting of n-alkyl groups which contain from 8 to 1000 carbon atoms.

Document WO2014/180843 dicloses a lubricant for a marine engine comprising at least one base oil, at least one overbased detergent, at least one neutral detergent and at least one fatty amine.

None of the prior art documents discloses the amines of formula (I) or (II) according to the invention and their use in a lubricating oil composition for improving the efficiency of the lubricant and the engine cleanliness, notably for reducing or preventing the formation of deposits in the hot section of the engine.

Actually, the operating temperature of marine engine and notably of two-stroke marine engine, still increases. Accordingly, the lubricant being directly in contact with the engine, and notably with the hot section of the engine as for example the segment-piston-pump assembly, shall ensure a resistance to an elevated temperature and thus, reduce or prevent the formation of deposits in the hot section of the engine.

Further, there is a need for marine lubricants having a low BN, notably having a BN inferior or equal to BN 40, able to be used in presence of low-sulphur fuels (content of sulphur being inferior to 0.5%) and having an increased thermal resistance.

Thus, it would be desirable to have a marine lubricant, especially for two-stroke marine engine, which can have a high BN, especially close to or equal to BN 100, or a low BN, especially close to or equal to 25, while having a resistance to the increased temperature and thus a lower risk of deposits formation in the hot section of the engine.

It would also be desirable to have a lubricant for marine engines, including for a two-stroke marine engine, displaying nor or few risk of viscosity increase over time, and particularly during its use.

An object of the present invention is to provide a lubricant composition overcoming all or part of the aforementioned drawbacks.

Another object of the present invention is to provide a lubricant composition resistant to aging while maintaining its properties over time.

Another object of the present invention is to provide a lubricant composition whose formulation is easy to implement.

Another object of the present invention is to provide a method for lubricating a marine engine, and especially for lubricating a two-stroke marine engine used with both low-sulphur fuel and high-sulphur fuel.

Another object of the present invention is to provide a method for lubricating a marine engine, and especially a for a two-stroke marine engine used with very low-sulphur fuel.

An other object of the present invention is to provide a method for reducing the formation of deposits in the hot section of a marine engine, notably of a two-stroke marine engine.

The term "consists essentially of" followed by one or more characteristics, means that may be included in the process or the material of the invention, besides explicitly listed components or steps, components or steps that do not materially affect the properties and characteristics of the invention.

The expression "comprised between X and Y" includes boundaries, unless explicitly stated otherwise. This expression means that the target range includes the X and Y values, and all values from X to Y.

Throughout the description and claims of this specification, the words "comprise" and "contain" and variations of the words, for example "comprising" and "comprises", mean "including but not limited to", and do not exclude other moieties, additives, components, integers or steps. Moreover, the singular encompasses the plural unless the context otherwise requires: in particular, where the indefinite article is used, the specification is to be understood as contemplating plurality as well as singularity, unless the context requires otherwise.

Where upper and lower limits are quoted for a property, for example for the concentration of a component, then a range of values defined by a combination of any of the upper limits with any of the lower limits may also be implied.

The present invention concerns a lubricant composition comprising:

at least one lubricant base oil, at least a di-fatty-alkyl(ene) polyalkylamine (designated "polyalkylamine") mixture or composition comprising one or more polyalkylamines of formulae (I) or (II):

(I)

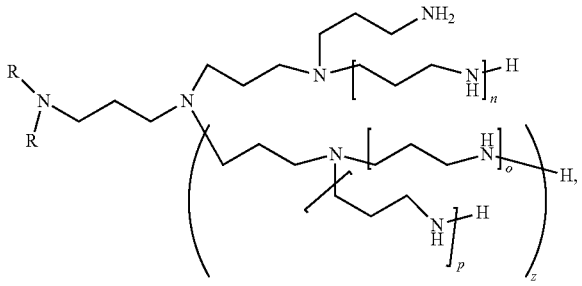

(II)

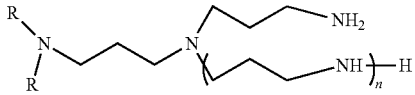

wherein, each R is, independent of the other R, an alkyl moiety or an alkylene moiety with 8 to 22 carbon atoms, which is linear or branched, n and z are independent of each other either 0, 1, 2, or 3, and when z is superior than 0 then o and p are independent of each other either 0, 1, 2, or 3, or derivatives thereof, whereby said polyalkylamine mixture or composition comprises at least 3% by weight of branched compounds of formula (I) or (II), with regards to the total weight of polyalkylamine compounds (I) and (II) in the composition, branched compound signifying that:

in formula (I) at least one of n and z are superior or equal to 1, in formula (II) n is superior or equal to 1.

Suitably the mixtures or compositions of polyalkylamines comprise at least 5% by weight, with regards to the total weight of polyalkylamine compounds (I) and (II) in the composition, of products (I) and (II) with a pure linear structure, since such products were found to have a desirable viscosity profile. Pure linear structure means n is 0 in formulae (I) and (II) and z is 0 in formula (I)

The Applicant has found that a significant part of the BN provided by fatty amines which are soluble in the lubricating base oil, allows maintaining the same level of performance for a marine lubricant compared to conventional formulations of equivalent or higher BN.

Said performances are in particular the reduction of deposit formation, measured using the ECBT test described below.

The lubricant composition according to the invention thus has such performances, while maintaining a viscosity that makes it suitable for the intended use.

Accordingly, the present invention allows formulating lubricant compositions with high BN for a marine engine, in particular for a two-stroke marine engine, that can be operated with both high sulphur fuel and low sulphur fuels, and with limited risk of the formation of deposits, while maintaining the other performances of the lubricating composition at a satisfactory level.

Alternatively, the present invention allows formulating lubricant compositions with low BN for a marine engine, especially for a two-stroke marine engine, that can be operated with very low sulphur fuel, and with limited risk of the formation of deposits while maintaining the other performances of the lubricating composition at a satisfactory level.

Further, the lubricant compositions according to the invention have an efficient neutralization capacity of sulphuric acid.

Further, the lubricant compositions according to the invention have also an increased thermal resistance, notably at high temperature.

Advantageously, the lubricant compositions according to the invention maintain good viscosity stability over time.

Advantageously, the lubricant compositions according to the invention bear few or no risk of thickening based on conditions of use.

In an embodiment, the polyalkylamine mixtures or compositions comprise at least 4% by weight (% w/w) with regards to the total weight of compounds of formula (I) or (II), suitably at least 5% w/w, suitably at least 6% w/w, suitably more than 7% w/w, suitably more than 7.5% w/w, suitably more than 10% w/w, suitably more than 20% w/w of branched compounds whereof at least one of n or z is superior or equal to 1. For the products of formula (I) this means that at least one of n or z must be superior or equal to 1. For the products of formula (II) this means that n must be superior or equal to 1.

It is noted that whenever n, o, p, or z is 0, then the hydrogen represented at the extremity of the chain is covalently bound to the corresponding secondary nitrogen.

Preferably the di-fatty-alkyl(ene) polyalkylamine mixture or composition comprises compounds of formula (I) or (II) wherein n, o, p, and z, when not 0, are 1 or 2, more preferably n, o, p, and z, when not 0, are 1.

According to one favorite embodiment, the di-fatty-alkyl (ene) polyalkylamine mixture or composition consists essentially of compounds of formula (I) or (II) wherein n, o, p, and z, are independently 0, 1 or 2, more preferably n, o, p, and z, are independently 0 or 1.

According to another favorite embodiment, the di-fatty-alkyl(ene) polyalkylamine mixture or composition consists essentially of compounds of formula (I) or (II) and their derivatives, wherein n, o, p, and z, are independently 0, 1 or 2, more preferably n, o, p, and z, are independently 0 or 1.

Derivatives of compounds (I) and (II) are described here-under.

In an embodiment, each R is, independent of the other R, an alkyl moiety with 14 to 22 carbon atoms, preferably with 14 to 18 carbon atoms, more preferably with 16 to 18 carbon atoms, which is linear or branched.

Although the two R groups can be different, they are, in one embodiment, the same, since such materials are more economically produced. Irrespective of whether they are the same or not, one or both of the R groups, independently, are typically derived from chemical feedstock or from a natural source, such as from natural oils and fats. Particularly if a natural source is used, it means that each R group may have a certain distribution in the carbon chain length. Suitably R is derived from animal and vegetal oils and fats, such as tallow, coco and palm oil. Since making the di-fatty-alkyl (ene) polyalkylamines in accordance with the invention comprises a hydrogenation step, it may be beneficial to use hydrogenated R groups in the process for making the products of the invention. However, for certain feedstocks, even after hydrogenization, an appreciable amount of unsaturated bonds may remain. Suitably a fully hydrogenated tallow group is used as the R group, and the corresponding mixture of di-fatty-alkyl(ene) polyalkyl amines are formed. Alternatively, the R group of the raw material is unsaturated whereby the unsaturated R group may be wholly or partially hydrogenated during the process to make the claimed di-fatty-alkyl(ene) polyalkylamines being a mixture of di-fatty-alkyl polyalkylene amines and di-fatty-alkylene polyalkylene amines. Also products with one fully saturated R group and one unsaturated R group are products of the invention.

Therefore, as used herein, "di-fatty-alkyl(ene) polyalkylamines" refers to di-fatty-alkyl polyalkylamines, di-fatty-alkylene polyalkylamines, fatty-alkyl fatty-alkylene polyalkylamines, and mixtures thereof.

Derivatives of the di-fatty-alkyl(ene) polyalkylamines compositions of the invention include products wherein one or more of the NH moieties of the dialkyl polyalkylamines of the invention are methylated, alkoxylated, or both. Such products were found to have desirable solubility, particularly in lubricating oils. Alkoxylated derivatives are suitably butoxylated, propoxylated and/or ethoxylated. If two or more different alkoxylation agents are used, they can be used in any sequence, e.g. EO-PO-EO, and the various alkoxy units can be of blocky nature and/or be present in a random fashion. Suitably a primary —$NH_2$ group is alkoxylated with one or more alkylene oxides in a conventional way to form a —NH-AO-H group, wherein AO stands for one or more alkylene-oxy units. The resulting —NH-AO-H group can be further alkoxylated to form —$N(AO\text{-}H)_2$ groups. Especially when large amounts of alkylene oxide (i.e. when more than 8 AO molecules per polyalkylamine molecule) are used, typically also one or more of the secondary amine functions, if present, are alkoxylated.

In an embodiment, all primary and secondary amine functions of the di alkyl polyamine are alkoxylated. In another embodiment, the di-fatty-alkyl(ene) polyalkylamines are derivatized by methylating one or more of the N—H functions in a conventional way, for example by reaction with formic acid and formaldehyde. In another embodiment, one or more of the O—H functions of an alkoxylated di-fatty-alkyl(ene) polyalkylamines is methylated in a conventional way.

The compositions comprising mixtures of polyalkylamines of the formula (I) are preferred. However, since compositions comprising mixtures of polyalkylamines of the formula (II) can be more economical to make, under specific circumstances, compositions comprising mixtures of polyalkylamines of the formula (II) may be preferred. If suitable, compositions comprising mixtures of polyalkylamines of the formulae (I) and (II) are used.

The branched polyalkylamines as claimed can be produced using any conventional process steps that are conducted in such order and way that the claimed mixtures are obtained. A suitable way to produce them is described in the experimental section below, starting from a diamine and involving two or more cycles, for economic reasons preferably two, each cycle including a cyanoethylation step and a hydrogenation step. Hereinafter this process is named the two-step process. However, in an alternative process, one equivalent of a di-alkyl(ene)-diamine is reacted in one step with two or more equivalents of acrylonitrile, followed by hydrogenation. In that case, optional further cycles involving a cyanoethylation and a hydrogenation step can be performed. Such a one-step process can be beneficial since it requires less reaction steps.

For increased branching in the two-cycle process, an acidic catalyst is used, such as HCl or acetic acid. Also increasing the reaction temperature during cyanoethylation will result in increased branching in this process. In an embodiment of a multicycle process, the temperature of a later cyanoethylation step is higher than the temperature in an earlier cyanoethylation step, to get a product with the desired branching. In an embodiment, more than 1 mole of acrylonitrile is used per mole of the starting polyamine, which was also found to increase the branching of the resulting product to the desired level.

The temperature in each cyanoethylation step is suitably selected in the range from 70 to 125° C. In an embodiment the reaction is conducted, for economic reasons, at a temperature up to 80, 85, 90, 95, or 100° C.

For maintaining a homogeneous reaction mixture, a solvent is suitably used. Suitable solvents include $C_{1-4}$ alcohols and $C_{2-4}$ diols. Ethanol may be a solvent of choice for ease of handling. Surprisingly the $C_{1-4}$ alcohols and $C_{2-4}$ diols were found not to be mere solvents. They turned out to also have co-catalytic activity in the cyanoethylation step.

The amount of solvent to be used can vary over a wide range. For economic purposes, the amount is typically kept at a minimum. The amount of solvent, particularly in a cyanoethylation step, is suitably less than 50, 40, 30, or 25% by weight of the liquid reaction mixture. The amount of solvent, particularly in a cyanoethylation step, is suitably more than 0.1, 0.5, 1, 5, or 10% by weight of the liquid reaction mixture.

In an embodiment, the di-fatty-alkyl(ene) polyalkylamine mixture or composition according to the invention has a BN measured according to standard ASTM D-2896 comprised between 150 and 350 milligrams of potash per gram of amine, preferably between 170 and 340 and more preferably between 180 and 320.

In an embodiment, the lubricant composition according to the invention has a BN, measured according to standard ASTM D-2896, greater than or equal to 70, preferably greater than or equal to 80, more preferably greater than or equal to 90, advantageously greater than or equal to 95 milligrams of potash per gram of lubricant.

In a preferred embodiment, the lubricant composition according to the invention has a BN, measured according to standard ASTM D-2896, comprised between 70 and 120, preferably between 70 and 100, more preferably between 80 and 100, advantageously between 90 and 100 milligrams of potash per gram of lubricant.

Preferably, the lubricant composition according to the invention has a BN, measured according to standard ASTM D-2896, approximately equal to 100 milligrams of potash per gram of lubricant.

In an embodiment, in the cylinder lubricants according to the invention, the percentage by mass of di-fatty-alkyl(ene) polyalkylamine mixture with respect to the total weight of lubricant is chosen such that the BN provided by these compounds represents a contribution comprised between 5 and 60 milligrams of potash per gram of lubricant, preferably between 10 and 30 milligrams of potash per gram of lubricant of the total BN of said cylinder lubricant, determined according to the standard ASTM D-2896.

In said embodiment, the percentage by mass of di-fatty-alkyl(ene) polyalkylamine mixture or composition with respect to the total weight of lubricant is comprised between 2 and 10%, preferably between 3 and 10%, more preferably between 4 and 9%.

In another embodiment, the lubricant composition according to the invention has a BN, measured according to standard ASTM D-2896, at most of 50, preferably at most of 40, more preferably at most of 30 milligrams of potash per gram of lubricant.

In a preferred embodiment, the lubricant composition according to the invention has a BN, measured according to standard ASTM D-2896, comprised between 10 and 30, preferably between 15 and 30, more preferably between 15 and 25 milligrams of potash per gram of lubricant.

Preferably, the lubricant composition according to the invention has a BN, measured according to standard ASTM D-2896, equal to 25 milligrams of potash per gram of lubricant.

In said embodiment, the percentage by mass of di-fatty-alkyl(ene) polyalkylamine mixture or composition with respect to the total weight of lubricant is comprised between 0.1 and 15%, preferably between 0.5 and 10%, more preferably between 3 and 10%.

The lubricant composition according to the invention comprises at least one lubricant base oil selected from a synthetic, a vegetable or a mineral oil (most often a Group 1 oil according to the API classification).

Generally, the oils also called "base oils" or "lubricant base oils" used for formulating lubricant compositions according to the present invention may be oils of mineral, synthetic or plant origin, as well as their mixtures. The mineral or synthetic oils generally used in the application belong to one of the classes defined in the API classification as summarized below:

| | Saturated substance content | Sulfur content | Viscosity Index |
|---|---|---|---|
| Group 1 Mineral oils | <90% | >0.03% | 80 ≤ VI < 120 |
| Group 2 Hydrocracked oils | ≥90% | ≤0.03% | 80 ≤ VI < 120 |
| Group 3 Hydroisomerized oils | ≥90% | ≤0.03% | ≥120 |
| Group 4 | PAOs | | |
| Group 5 | Other bases not included in the base Groups 1 to 4 | | |

These mineral oils of Group 1 may be obtained by distillation of selected naphthenic or paraffinic crude oils followed by purification of these distillates by methods such as solvent extraction, solvent or catalytic dewaxing, hydrotreating or hydrogenation.

The oils of Groups 2 and 3 are obtained by more severe purification methods, for example a combination of hydrotreating, hydrocracking, hydrogenation and catalytic dewaxing.

Examples of synthetic bases of Groups 4 and 5 include poly-alpha olefins, polybutenes, polyisobutenes, alkylbenzenes.

These base oils may be used alone or as a mixture. A mineral oil may be combined with a synthetic oil.

The lubricant compositions of the invention may have a viscosity grade of SAE-20, SAE-30, SAE-40, SAE-50 or SAE-60 according to the SAEJ300 classification. Grade 20 oils have a kinematic viscosity at 100° C. of between 5.6 and 9.3 $mm^2/s$. Grade 30 oils have a kinematic viscosity at 100° C. of between 9.3 and 12.5 $mm^2/s$. Grade 40 oils have a kinematic viscosity at 100° C. of between 12.5 and 16.3 $mm^2/s$. Grade 50 oils have a kinematic viscosity at 100° C. of between 16.3 and 21.9 $mm^2/s$. Grade 60 oils have a kinematic viscosity at 100° C. of between 21.9 and 26.1 $mm^2/s$.

In a preferred embodiment, the lubricant compositions according to the invention have a kinematic viscosity at 100° C. of between 12.5 and 26.1 $mm^2/s$, preferably between 16.3 and 21.9 $mm^2/s$, said kinematic viscosity being measured according to ASTM D445.

Preferably, the lubricant composition according to the first aspect of the invention is a cylinder lubricant.

The cylinder oils for two-stroke diesel marine engines generally have a viscosimetric grade SAE-40 to SAE-60, preferentially SAE-50 equivalent to a kinematic viscosity at 100° C. comprised between 16.3 and 21.9 $mm^2/s$. Typically, a conventional formulation of cylinder lubricant for slow two-stroke marine diesel engines is of grade SAE 40 to SAE 60, preferentially SAE 50 (according to the SAE J300 classification) and comprises at least 50% by weight of a lubricating base oil of mineral and/or synthetic origin, adapted to the use in a marine engine, for example of the API Group 1 class, i.e. obtained by distillation of selected crude oils followed by purification of these distillates by methods such as solvent extraction, solvent or catalytic dewaxing, hydrotreating or hydrogenation. Their viscosity index (VI) is comprised between 80 and 120; their sulfur content is greater than 0.03% and their saturated substance content is less than 90%. These viscosities may be obtained by mixing additives and base oils, for example base oils containing mineral bases of Group 1 such as Neutral Solvent (for example 150 NS, 500 NS or 600 NS) bases and brightstock. Any other combination of mineral, synthetic bases or bases of plant origin, having, as a mixture with the additives, a viscosity compatible with the chosen SAE grade, may be used.

The quantity of base oil in the lubricant composition of the invention is from 30% to 80% by weight, relative to the total weight of the lubricant composition, preferably from 40% to 80%.

The lubricant composition according to the invention could further comprise additives chosen amongst a neutral detergent, an overbased detergent or mixtures thereof.

Detergents are typically anionic compounds containing a long lipophilic hydrocarbon chain and a hydrophilic head, wherein the associated cation is typically a metal cation of an alkali metal or alkaline earth metal. The detergents are preferably selected from alkali metal salts or alkaline earth metal (particularly preferably calcium, magnesium, sodium or barium) salts of carboxylic acids, sulphonates, salicylates, naphthenates, as well as the salts of phenates. These metal salts may contain the metal in an approximately stoichiometric amount relative to the anion group(s) of the detergent. In this case, one refers to non-overbased or "neutral" detergents, although they also contribute a certain basicity. These "neutral" detergents typically have a BN (Number Base or basicity index) measured according to ASTM D2896, of less than 150 mg KOH/g, or less than 100 mg KOH/g, or less than 80 mg KOH/g of detergent. This type of so-called neutral detergent may contribute in part to the BN of the lubricating compositions. For example, neutral detergents are used such as carboxylates, sulphonates, salicylates, phenates, naphthenates of the alkali and alkaline earth metals, for example calcium, sodium, magnesium, barium. When the metal is in excess (amount greater than the stoichiometric amount relative to the anion groups(s) of the detergent), then these are so-called overbased detergents. Their BN is high, higher than 150 mg KOH/g of detergent, typically from 200 to 700 mg KOH/g of detergent, preferably from 250 to 450 mg KOH/g of detergent. The excess metal providing the character of an overbased detergent is in the form of insoluble metal salts in oil, for example carbonate, hydroxide, oxalate, acetate, glutamate, preferably carbonate. In one overbased detergent, the metals of these insoluble salts may be the same as, or different from, those of the oil soluble detergents. They are preferably selected from calcium, magnesium, sodium or barium. The overbased detergents are thus in the form of micelles composed of insoluble metal salts that are maintained in suspension in the lubricating composition by the detergents in the form of soluble metal salts in the oil. These micelles may contain one or more types of insoluble metal salts, stabilised by one or more types of detergent. The overbased detergents comprising a single type of detergent-soluble metal salt are generally named according to the nature of the hydrophobic chain of the latter detergent. Thus, they will be called a phenate, salicylate, sulphonate, naphthenate type when the detergent is respectively a phenate, salicylate, sulphonate or naphthenate. The overbased detergents are called mixed type if the micelles comprise several types of detergents, which are different from one another by the nature of their hydrophobic chain. The overbased detergent and the neutral detergent may be selected from carboxylates, sulphonates, salicylates, naphthenates, phenates and mixed detergents combining at least two of these types of detergents. The overbased detergent and the neutral detergent include compounds based on metals selected from calcium, magnesium, sodium or barium, preferably calcium or magnesium. The overbased detergent may be overbased by metal insoluble salts selected from the group of carbonates of alkali and alkaline earth metals, preferably calcium carbonate. The lubricating composition may comprise at least one overbased detergent and at least a neutral detergent as defined above.

In an embodiment, the lubricant composition according to the invention has a BN determined according to the standard ASTM D-2896 of at most 50, preferably at most 40, advantageously at most 30 milligrams of potassium hydroxide per gram of the lubricating composition, in particular ranging from 10 to 30, preferably from 15 to 30, advantageously from 15 to 25 milligrams of potassium hydroxide per gram of the lubricant composition. In this embodiment of the invention, the lubricating composition may not comprise detergents based on alkali or alkaline earth metals overbased with metallic carbonate salts.

In another embodiment of the invention, the lubricant composition has a BN determined according to the standard ASTM D-2896 of at least 50, preferably at least 60, more preferably at most 70, advantageously 70 to 100.

The lubricant composition according to the invention could further comprise an additional additive chosen amongst:

- Primary, secondary or tertiary fatty monoalcohols having a saturated or unsaturated, linear or branched, alkyl chain comprising at least 12 carbon atoms, preferably from 12 to 24 carbon atoms, more preferably from 16 to 18 carbon atoms, advantageously primary fatty monoalcohols having a saturated and linear alkyl chain,
- Saturated fatty esters obtained from mono acids comprising at least 14 carbon atoms and alcohols comprising at least 6 carbon atoms.

In an embodiment, the amount of the additional additive in the lubricant composition according to the invention is from 0.01 to 10%, preferably from 0.1 to 2% by weight relative to the total weight of the lubricant composition.

In one embodiment, the lubricant of the first aspect further comprises an optional additive chosen amongst an anti-wear additive, a polymer, a dispersing additive, an anti-foaming additive or a mixture thereof.

Polymers are typically polymers having a low molecular weight of from 2000 to 50 000 dalton (Mn). The polymers are selected amongst PIB (of from 2000 Dalton), polyAcrylate or Poly Metacrylates (of from 30 000 Dalton), olefin copolymers, olefin and alpha-olefin copolymers, EPDM, polybutenes, poly alpha-olefin having a high molecular weight (viscosity 100° C.>150), hydrogenated or non-hydrogenated styrene-olefin copolymers.

Anti-wear additives protect the friction surfaces by forming a protective film adsorbed on these surfaces. The most commonly used is zinc dithiophosphate or ZnDTP. Also in this category, there are various phosphorus, sulphur, nitrogen, chlorine and boron compounds. There are a wide variety of anti-wear additives, but the most widely used category is that of the sulphur phospho additives such as metal alkylthiophosphates, especially zinc alkylthiophosphates, more specifically, zinc dialkyl dithiophosphates or ZnDTP. The preferred compounds are those of the formula $Zn((SP(S)(OR_1)(OR_2))2$, wherein $R_1$ and $R_2$ are alkyl groups, preferably having 1 to 18 carbon atoms. The ZnDTP is typically present at levels of about 0.1 to 2% by weight relative to the total weight of the lubricating composition. The amine phosphates, polysulphides, including sulphurised olefins, are also widely used anti-wear additives. One also usually finds nitrogen and sulphur type anti-wear and extreme pressure additives in lubricating compositions for marine engines, such as, for example, metal dithiocarbamates, particularly molybdenum dithiocarbamate. Glycerol esters are also anti-wear additives. Mention may be made of mono-, di- and trioleates, monopalmitates and monomyristates. In one embodiment, the content of anti-wear additives ranges from 0.01 to 6%, preferably from 0.1 to 4% by weight relative to the total weight of the lubricating composition.

Dispersants are well known additives used in the formulation of lubricating compositions, in particular for application in the marine field. Their primary role is to maintain in suspension the particles that are initially present or appear in the lubricant during its use in the engine. They prevent their agglomeration by playing on steric hindrance. They may also have a synergistic effect on the neutralisation. Dispersants used as lubricant additives typically contain a polar group, associated with a relatively long hydrocarbon chain, generally containing 50 to 400 carbon atoms. The polar group typically contains at least one nitrogen, oxygen, or phosphorus element. Compounds derived from succinic acid are particularly useful as dispersants in lubricating compositions. Also used are, in particular, succinimides obtained by condensation of succinic anhydrides and amines, succinic esters obtained by condensation of succinic anhydrides and alcohols or polyols. These compounds can then be treated with various compounds including sulphur, oxygen, formaldehyde, carboxylic acids and boron-containing compounds or zinc in order to produce, for example, borated succinimides or zinc-blocked succinimides. Mannich bases, obtained by polycondensation of phenols substituted with alkyl groups, formaldehyde and primary or secondary amines, are also compounds that are used as dispersants in lubricants. In one embodiment of the invention, the dispersant content may be greater than or equal to 0.1%, preferably from 0.5 to 2%, advantageously from 1 to 1.5% by weight relative to the total weight of the lubricating composition. It is possible to use a dispersant from the PIB succinimide family, e.g. boronated or zinc-blocked.

Other optional additives may be chosen from thickeners, defoamers to counter the effect of the detergents. They may be selected from, for example, polar polymers such as polydimethylsiloxanes, polyacrylates, antioxidant and/or anti-rust additives, for example organometallic detergents or thiadiazoles. These are known to persons skilled in the art. These additives are generally present in a weight content of 0.1 to 5% based on the total weight of the lubricating composition.

The present invention also concerns the use of the lubricant composition as above-defined for lubricating a marine engine, notably a two stroke marine engine.

The set of features, preferences and advantages disclosed for the lubricant composition according to the invention also apply to the above use.

The present invention also concerns the use of the lubricant composition as above-defined as a cylinder lubricant able to be used with fuels having a content of sulphur inferior than 1% by weight, relative to the total weight of fuel, with fuels having a content of sulphur comprised between 1 and 3.5% by weight, relative to the total weight of fuel, or with fuels having a content of sulphur superior than 3.5% by weight, relative to the total weight of fuel.

In an embodiment, the lubricant composition as above-defined as a cylinder lubricant is able to be used with fuels having a content of sulphur inferior than 1% by weight relative to the total weight of fuel and with fuels having a content of sulphur of from 1 to 3.5% by weight relative to the total weight of fuel.

The set of features, preferences and advantages disclosed for the lubricant composition according to the invention also apply to the above use.

In said embodiment, the use corresponds to the use of lubricant compositions according to the invention having a BN, measured according to standard ASTM D-2896, greater than or equal to 70, preferably greater than or equal to 80, more preferably greater than or equal to 90, advantageously greater than or equal to 95 milligrams of potash per gram of lubricant.

Preferably, the lubricant composition according to the invention has a BN, measured according to standard ASTM D-2896, of from 70 to 120, preferably from 70 to 100, more preferably from 80 to 100, advantageously from 90 to 100 milligrams of potash per gram of lubricant.

More preferably, the lubricant composition according to the invention has a BN, measured according to standard ASTM D-2896, approximately equal to 100 milligrams of potash per gram of lubricant.

The present invention also concerns the use of the lubricant composition as above-defined as a cylinder lubricant able to be used with fuels having a content of sulphur inferior than 0.5% by weight relative to the total weight of fuel.

The set of features, preferences and advantages disclosed for the lubricant composition according to the invention also apply to the above use.

In said embodiment, the use corresponds to the use of lubricant composition according to the invention having a BN, measured according to standard ASTM D-2896, at most of 50, preferably at most of 40, more preferably at most of 30 milligrams of potash per gram of lubricant.

Preferably, the lubricant composition according to the invention has a BN, measured according to standard ASTM D-2896, of from 10 to 30, preferably from 15 to 30, more preferably from 15 to 25 milligrams of potash per gram of lubricant.

More preferably, the lubricant composition according to the invention has a BN, measured according to standard ASTM D-2896, approximately equal to 25 milligrams of potash per gram of lubricant.

The present invention also concerns the use of the lubricant composition as above-defined for reducing the formation of deposits in the hot section of a marine engine, notably of a two stroke marine engine.

In a marine engine, notably in a two stroke marine engine, some sections are subjected to high temperatures up to 300° C. This is preferably the segment-pistons-pump zone.

Thus, the lubricant composition according to the invention, in contact with the hot sections, can be subjected to very high temperatures, hence the need to provide it with increased thermal resistance.

The set of features, preferences and advantages disclosed for the lubricant composition according to the invention also apply to the above use.

The present invention also concerns a method for lubricating a marine engine, and more particularly a two-stroke marine engine, comprising operating the engine with a lubricant according to the invention.

The set of features, preferences and advantages disclosed for the lubricant composition according to the invention also apply to the above method.

The present invention also concerns a method for reducing the formation of deposits in the hot section of a marine engine, notably of a two-stroke marine engine, comprising contacting said hot section of the engine with a lubricant according to the invention. The set of features, preferences and advantages disclosed for the lubricant composition according to the invention also apply to the above method.

The present invention also concerns the use of at least one fatty amine in a lubricant composition for reducing the formation of deposits in the hot section of a marine engine, notably of a two-stroke marine engine, wherein said fatty amine is a di-fatty-alkyl(ene) polyalkylamine mixture comprising one or more polyalkylamines of formulae (I) or (II):

(I)

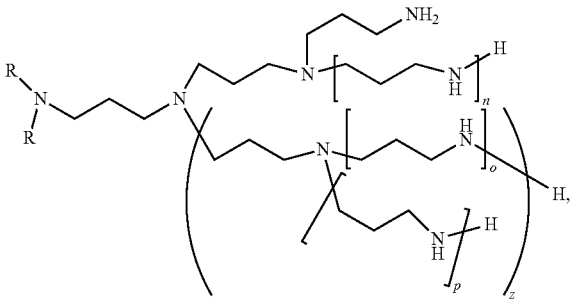

(II)

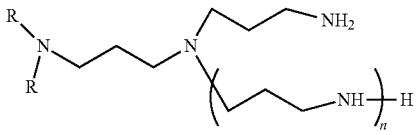

wherein, each R is, independent of the other R, an alkyl moiety with 8 to 22 carbon atoms, which is linear or branched, n and z are independent of each other either 0, 1, 2, or 3, and when z is superior than 0 then o and p are independent of each other either 0, 1, 2, or 3, or derivatives thereof, whereby said mixture comprises at least 3% by weight of branched compounds of formula (I) or (II), with regards to the total weight of polyalkylamine compounds (I) and (II) in the composition, branched compound signifying that:

in formula (I) at least one of n and z are superior or equal to 1, in formula (II) n is superior or equal to 1.

The set of features, preferences and advantages disclosed for the di-fatty-alkyl(ene) polyalkylamine mixture according to the invention also apply to the above use.

The percentages here-above defined correspond to weight percent of active material. It should be appreciated that the various aspects and embodiments of the detailed description as disclosed herein are illustrative of the specific ways to make and use the invention and do not limit the scope of invention when taken into consideration with the claims and the detailed description. It will also be appreciated that features from different aspects and embodiments of the invention may be combined with features from different aspects and embodiments of the invention.

EXAMPLE 1: SYNTHESIS OF THE PRODUCT 2HTY OF FORMULA (II) WITH N=1

Duomeen® 2HT is available from AkzoNobel.

Other chemicals were sourced from SigmaAldrich, unless indicated differently.

A fully branched product with 4 amine functions was prepared using a 1 L glass reactor with turbine stirrer to which chemicals can be dosed using a Prominent Gamma/L membrane pump and which was thermostatted using a Lauda K6KP heating bath.

Raw Materials

| Chemical | Supplier | Intake (g) | Molw. (g/mol) | Intake (mol) |
|---|---|---|---|---|
| Duomeen ® 2HT | AkzoNobel | 342.0 | 566 | 0.604 |
| Hydrochloric acid (36%) | JT Baker | 3.06 | 36.5 | 0.014 |
| Water | Tap | 1.12 | 18.0 | 0.062 |
| Isopropanol | JT Baker | 34.2 | 60.1 | 0.569 |
| Sodium carbonate | Acros | As needed, see text | | |
| Acrylonitrile | Acros | 81.5 | 53.1 | 1.299 |
| Raney Cobalt | CatAlloy | As needed, see text | | |
| Ammonia | Air products | As needed, see text | | |

Procedure & Results

The cyano-ethylation step is performed by charging the reactor with Duomeen 2HT, isopropanol (co-catalyst and solvent for the dicyano-product that is formed), water, and HCl, and subsequent dosing, in approximately three hours, of the acrylonitrile. Reaction pathway:

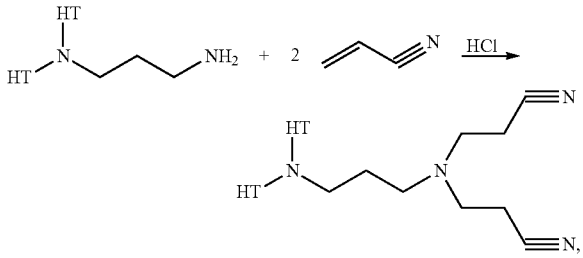

wherein HT stands for hydrogenated tallow.

After a conversion of 80% the reaction rate was so slow that the reaction was stopped. Vacuum was applied to the reactor, the temperature was increased to 110° C. to remove the acrylonitrile, water & IPA. The product was washed and neutralized in two steps with 4% $Na_2CO_3$ solution to remove all HCl, and subsequently hydrogenated using the same equipment. Reaction pathway:

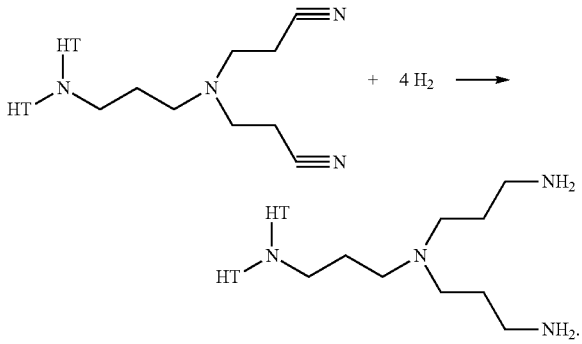

(2HTY)

Thereto the stirred reactor containing the dicyano-product was charged with a conventional Raney Cobalt catalyst, such as A-7000 ex Johnson Matthey or Acticat®1100 ex CatAlloy, and subsequently heated to 130° C. while sparging with nitrogen, to remove traces of acrylonitrile and water. Then the reactor was charged with ammonia (13-14.$10^5$ Pa) while kept at a temperature of 105° C. Then the reactor was heated to 150° C., and hydrogen was added to maintain a pressure of $49.10^5$ Pa. After completion of the reaction, the temperature was lowered to 80° C. and remaining hydrogen and ammonia were flushed out using nitrogen.

The resulting composition was analyzed using GC-MS and found to contain>70% of the product 2HTY of formula (II) with n=1, as well as more than 14% w/w of the linear product $(HT)_2N—(CH_2)_3—NH—(CH_2)_3—NH_2$, a little starting product $(HT)_2N—(CH_2)_3—NH_2$, and some unidentified further alkylamines.

EXAMPLE 2A AND 2B: SYNTHESIS OF A MIXTURE OF LINEAR AND BRANCHED PRODUCT (TETRAMEEN® 2HTB)

A mixture of linear and branched product (Tetrameen® 2HTb) was prepared by the two cycle procedure wherein the cyano-ethylation and the hydrogenation steps above were repeated. The 0.6 mole of the Duomeen® 2HT was combined with 0.65 mole of acrylonitrile and reacted in the first cyano-ethylation step. After hydrogenation, the triamine was combined with another 0.65 mole of acrylonitrile and reacted. At the end of each cyano-ethylation step, NMR was used to analyze the reaction mixture and to determine if one mole of acrylonitrile had reacted per mole of starting material. If the reaction rate was found to be too slow, some additional acrylonitrile was dosed and after 1 hour the analysis was repeated. This cycle was repeated till the desired reaction was obtained. The final product was analyzed using GC-MS applying the following conditions:

| | |
|---|---|
| Gas chromatograph | TRACE ULTRA GC Interscience |
| MS system | ISO GC-MS |
| Column | Fused silica WCOT, 20 m × 0.32 mm ID |
| stationary phase | Sil 5 CB, 100% polydimethyl-siloxane, cross-linked |
| film thickness | 0.12 μm |
| Carrier gas | Helium |
| flow | 2 ml/min. |
| Temperatures | |
| injector | 275° C. |
| column | initial: 200° C. during 1 min<br>rate: 20° C./min<br>final: 310° C. during 15 min |
| Injection volume | 1 μl, approx. 250 mg sample in 10 ml cyclohexane |

In the examples no additional acrylonitrile had to be added after the first cyanoacrylation step which was conducted at a temperature of 85° C. and 75° C., for examples 2a and 2b respectively. In the second cyanoacrylation step the temperature was 85 and 80° C., for examples 2a and 2b respectively. In example 2a an additional amount of 0.025 mole of acrylonitrile was needed to complete the second cyanoacrylation step, while in example 2b an additional amount of 0.12 mole of acrylonitrile was added before the addition of 0.60 mole of acrylonitrile was achieved. The highest amount of branching was observed in the sample that was highest in temperature.

It was confirmed that the off-white products, which were pasty/viscous liquids at room temperature, contained more than 13.8% w/w of branched product of formula (I) with one or more of n and z 1, and also contained more than 14% w/w of the linear product with n=z=0.

EXAMPLE 3: EVALUATION OF THERMAL RESISTANCE PROPERTIES OF LUBRICANT COMPOSITION ACCORDING TO THE INVENTION

A lubricant composition $C_1$, has been prepared with the following compounds:

lubricating base oil 1: Mineral oils Group I or brightstock of density between 895 and 915 kg/m$^3$, lubricating base oil 2: Group I mineral oils, in particular called 600R viscosity at 40° C. of 120 cSt measured according to ASTM D7279, detergent package comprising an anti-foaming agent Tetrameen® 2HTB, prepared by following the protocol of example 2a.

The composition $C_1$ is disclosed in Table II. The percentages disclosed in Table II correspond to weight percent.

TABLE II

| Composition | $C_1$ (invention) |
|---|---|
| Base oil 1 | 18.0 |
| Base oil 2 | 49.6 |
| Detergent package | 26.9 |
| Tetrameen ® 2HTB | 5.5 |
| TBN (Total base number in mgKOH/g of composition) | 100 |

The thermal behaviour of the composition $C_1$ was also measured by the continuous ECBT test on aged oil, where the mass of deposits (in mg) generated under determined conditions is measured. The lower this mass, the better the thermal behaviour.

This test makes it possible to simulate both the thermal stability and the detergency of the marine lubricants when the lubricant composition is injected on the hot section of an engine and notably, on the top of the piston and comprises three distinct phases. The first phase was realized at a temperature of 310° C.

The test utilizes aluminium beakers which are similar to pistons in shape. These beakers are placed in a glass container, maintained at a controlled temperature of the order of 60° C. The lubricant is placed in these containers, themselves equipped with a metallic brush, partially submerged in the lubricant. This brush is rotated at a speed of 1000 rpm, spraying lubricant over the inner surface of the beaker. The beaker is maintained at a temperature of 310° C. by an electric resistive heater, regulated by a thermocouple.

This first phase lasted 12 hours and the lubricant projection was continued for the duration of the test.

The second phase consists of a neutralization of 50 BN points of the lubricant composition with 95% sulfuric acid, in order to simulate the phenomenon of neutralization of the composition to be closer to real conditions of use of the lubricating composition in a marine engine.

The third phase is identical to the first, except that this phase has been carried out at a temperature of 270° C.

This procedure allows simulating the formation of deposits in the piston-segment assembly. The result is the weight of deposits measured in mg on the beaker.

The result is disclosed in Table III.

TABLE III

| Compositions | $C_1$ (invention) |
|---|---|
| ECBT on aged oil (mg) | 75 |

This result shows that the specific choice of a fatty amine according to the invention significantly reduces the formation of high temperature deposits, and therefore improves the heat resistance lubricating compositions.

EXAMPLE $C_2$ AND COMPARATIVE EXAMPLE A TO F

To a base oil comprising additives, a fatty acid alkyl polyamine according to the invention or according to the prior art was added and thoroughly blended, followed by neutralization of 50 BN points of the lubricant composition with 95% sulfuric acid, in order to simulate the phenomenon of neutralization of the composition to be closer to real conditions of use of the lubricating composition in a marine engine.

The structure of the tested alkyl polyamines is detailed in Table IV.

The composition of the lubricant oil is detailed in Table V.

Measurements of the viscosity (Pa·s) at 40° C. of the blends of lubricant and alkylpolyamines, as prepared above, were performed by measuring the viscosity at a shear rate of 0.01 $s^{-1}$. All measurements were performed at 40° C. on an RC301 rheometer from ANTON PAAR. The results are displayed in table V.

TABLE IV

| Example | Name | Nomenclature |
|---|---|---|
| $C_2$ | Tetrameen ® 2HTb | Mixture of compounds (I) and (II) |
| A | Tetrameen ® T | N- Mono tallow alkyl tripropylene tetramine |
| B | Duomeen ® 218 i | Di-N-C18alkyl propylene diamine (CH3-branched) |
| C | Triameen ® C | N- Mono coco alkyl dipropylene triamine |
| D | Triameen ® 2HT | N- Di(hydrogenated tallow alkyl) dipropylene triamine |
| E | Tetrameen ® OV | N- Mono-oleyl tripropylene tetra amine |
| F | Duomeen ® 2HT | Di-N-hydrogenated tallow propylene diamine |

TABLE V

| Composition | $C_2$ | A | B | C | D | E | F |
|---|---|---|---|---|---|---|---|
| Tetrameen ® 2HTb | 4.8 | — | — | — | — | — | — |
| Tetrameen ® T | — | 3.4 | — | — | — | — | — |
| Duomeen ® 218 i | — | — | 8.8 | — | — | — | — |
| Triameen ® C | — | — | — | 3.1 | — | — | — |
| Triameen ® 2HT | — | — | — | — | 6.3 | — | — |
| Tetrameen ® OV | — | — | — | — | — | 3.4 | — |
| Duomeen ® 2HT | — | — | — | — | — | — | 8 |
| Detergent package | 22.1 | 22.1 | 22.1 | 22.1 | 22.1 | 22.1 | 22.1 |
| Base oil 1 | 24.6 | 25.0 | 21.1 | 25.3 | 23.5 | 27.0 | 21.5 |
| Base oil 2 | 48.5 | 49.5 | 48 | 49.5 | 43.5 | 47.5 | 48.4 |
| Vicosity (Pa · s) | 0.30 | 0.75 | 0.40 | 6.90 | 0.58 | 1.10 | 0.40 |

From these results, it can be concluded that the alkyl polyamines according to the invention are superior to alkyl polyamines according to the prior art with regards to viscosity increase limitation: the viscosity of the finished oil composition comprising alkyl polyamines according to the invention does not increase after preparation as described here above as much as the increase of the viscosity of the finished oil comprising alkyl polyamines according to the prior art after preparation.

The invention claimed is:

1. Lubricant composition comprising:

at least one lubricant base oil, at least a di-fatty-alkyl(ene) polyalkylamine composition comprising one or more polyalkylamines of formulae (I) or (II):

(I)

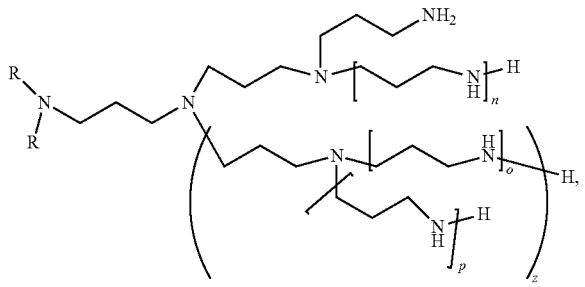

(II)

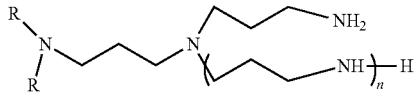

wherein, each R is, independent of the other R, an alkyl moiety or an alkylene moiety with 8 to 22 carbon atoms, which is linear or branched, n and z are independent of each other either 0, 1, 2, or 3, and when z is superior than 0 then o and p are independent of each other either 0, 1, 2, or 3, or derivatives thereof, whereby said polyalkylamine composition comprises at least 3% by weight of branched compounds of formula (I) or (II), with regards to the total weight of polyalkylamine compounds (I) and (II) in the composition, branched compound signifying that:

in formula (I) at least one of n and z are superior or equal to 1, in formula (II) n is superior or equal to 1.

2. Lubricant composition according to claim 1, wherein the polyalkylamine composition comprises at least 4% w/w of branched compounds of formula (I) or (II), with regards to the total weight of polyalkylamine compounds (I) and (II) in the composition, branched compound signifying that:

in formula (I) at least one of n or z are superior or equal to 1, in formula (II) n is superior or equal to 1.

3. Lubricant composition according to claim 1, wherein the polyalkylamine composition comprises at least 5% by weight, with regards to the total weight of compounds (I) and (II), of products of formulae (I) and (II) with a linear structure, linear meaning n is 0 in formulae (I) and (II) and z is 0 in formula (I).

4. Lubricant composition according to claim 1, wherein the polyalkylamine composition further comprises derivatives of polyalkylamines of formula (I) or (II), wherein said derivatives are alkoxylates which are optionally methylated.

5. Lubricant composition according to claim 1, wherein the polyalkylamine composition further comprises derivatives of polyalkylamines of formula (I) or (II), wherein said derivatives are methylated.

6. Lubricant composition according to claim 1, wherein the polyalkylamine composition has a BN measured according to standard ASTM D-2896 from 150 to 350 milligrams of potash per gram of amine compound.

7. Lubricant composition according to claim 1, having a BN, measured according to standard ASTM D-2896, greater than or equal to 70 milligrams of potash per gram of the lubricant composition.

8. Lubricant composition according to claim 7, wherein the percentage by mass of di-fatty-alkyl(ene) polyalkylamine mixture with respect to the total weight of the lubricant composition is from 2 to 10%.

9. Lubricant composition according to claim 1, having a BN determined according to the standard ASTM D-2896 of at most 50 milligrams of potassium hydroxide per gram of the lubricant composition.

10. Lubricant composition according to claim 9, wherein the percentage by mass of di-fatty-alkyl(ene) polyalkylamine mixture with respect to the total weight of the lubricant composition is comprised between 0.1 and 15%.

11. Lubricant composition according to claim 1, further comprising additives chosen amongst a neutral detergent, an overbased detergent or mixtures thereof.

12. Lubricant composition according to claim 1, wherein the percentage by mass of di-fatty-alkyl(ene) polyalkylamine mixture with respect to the total weight of lubricant is chosen such that the BN provided by these compounds represents a contribution comprised between 5 and 60 milligrams of potash per gram of lubricant, determined according to the standard ASTM D-2896.

13. Lubricant composition according to claim 12, wherein the percentage by mass of di-fatty-alkyl(ene) polyalkylamine mixture with respect to the total weight of lubricant is chosen such that the BN provided by these compounds represents a contribution comprised between 10 and 30 milligrams of potash per gram of lubricant of the total BN of said cylinder lubricant, determined according to the standard ASTM D-2896.

14. A method for lubricating a marine engine, comprising contacting the engine with a lubricant composition according claim 1 as a cylinder lubricant.

15. The method of claim 14, wherein the engine is a two-stroke marine engine.

16. The method of claim 14, comprising operating the engine with fuels having a content of sulphur inferior than 1% by weight relative to the total weight of fuel.

17. The method of claim 16, comprising operating the engine with fuels having a content of sulphur inferior than 0.5% by weight relative to the total weight of fuel.

18. The method of claim 14, comprising operating the engine with fuels having a content of sulphur from 1 to 3.5% by weight relative to the total weight of fuel.

19. The method of claim 14 for reducing the formation of deposits in the hot section of a marine engine.

* * * * *